US005531001A

United States Patent [19]

Beerli

[11] Patent Number: 5,531,001

[45] Date of Patent: Jul. 2, 1996

[54] DEVICE FOR YARN DIVISION ON A SECTIONAL WARPING MACHINE

[75] Inventor: Markus Beerli, Gossau, Switzerland

[73] Assignee: Benninger AG, Uzwil, Switzerland

[21] Appl. No.: 435,419

[22] Filed: May 10, 1995

[30] Foreign Application Priority Data

Jun. 20, 1994 [CH] Switzerland ..... 1940/94

[51] Int. Cl.[6] ..... D02H 9/00

[52] U.S. Cl. ..... 28/198

[58] Field of Search ..... 28/190, 191, 194, 28/195, 196, 197, 198, 199, 202, 208, 184

[56] References Cited

U.S. PATENT DOCUMENTS

| | | | |
|---|---|---|---|
| 4,438,553 | 3/1984 | Hamada | 28/198 |
| 4,893,386 | 1/1990 | Thier et al. | 28/198 |
| 5,027,485 | 7/1991 | Hager et al. | 28/194 |

FOREIGN PATENT DOCUMENTS

| | | |
|---|---|---|
| 270363 | 8/1963 | Switzerland . |
| 679867 | 4/1992 | Switzerland . |

*Primary Examiner*—C. D. Crowder
*Assistant Examiner*—Larry D. Worrell, Jr.
*Attorney, Agent, or Firm*—Shoemaker and Mattare, Ltd.

[57] ABSTRACT

During sizing division, a rod grid (19) comprising lease rods (*7a* to *7e*) is used for the formation of a shed, the rod grid being able to be raised with the aid of a lifting device (22) from a middle position into an upper operating position (O). A lower operating position (U) is limited by a mechanical stop (21), the individual lease rods being sequentially permitted to fall from the upper operating position into the lower operating position by a locking device. At the same time, a yarn shed is opened for each respective cross cord (12) insertion, the yarn shed lying in the same position for each yarn group. The opening angle β of the yarn shed can, in addition, be altered within specific limits. Automation of cross cord insertion is facilitated by this type of shed formation.

7 Claims, 3 Drawing Sheets

DEVICE FOR YARN DIVISION ON A SECTIONAL WARPING MACHINE

Figure 1:
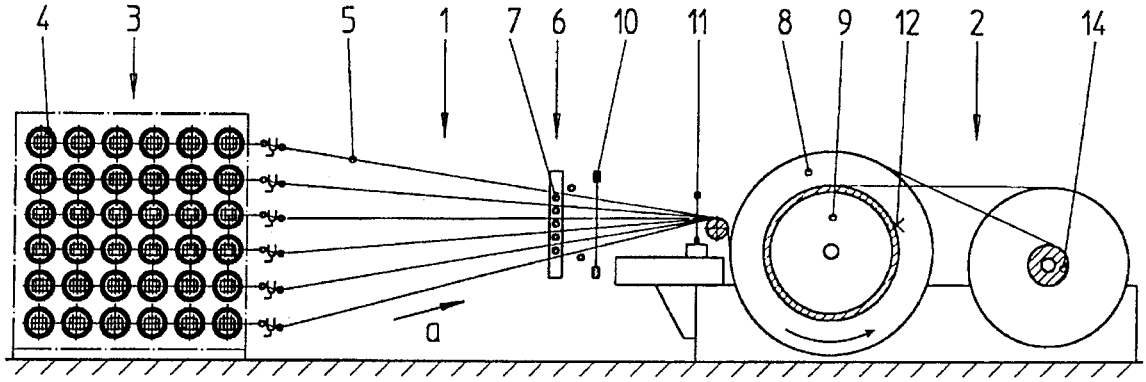

The invention concerns a device for yarn division on a sectional warping machine according to the preamble to claim 1. These types of devices serve to open the yarn strip, which has been wound off the bobbin creel onto the warping drum, in such a way that cross cords or other dividing elements can be inserted in order to establish the yarn sequence, or to form yarn groups for the subsequent sizing process.

In the case of straightforward formation of yarn crossings to establish the yarn sequence, in each case the entire yarn web is brought together in a single plane for the formation of a shed, every second yarn being deflected upwards or downwards with the aid of a cross-reed. In the case of the formation of multiple yarn crossings for the sizing process, shed formation is more complicated, since individual yarn groups, corresponding to the individual levels on the bobbin creel, must be separated. The invention in question concerns in particular a device for the multiple formation of yarn crossings, in order to create so-called sizing division.

A related and comparable device has been made known by CH-A-370 363, with which lease rods, with the exception of the uppermost and the lowermost, are able to be collectively lowered and individually raised in the lease rod holder, by which means the distance between two consecutive lease rods is able to be enlarged in each case, for the purposes multiple of yarn leasing. A ratchet mechanism, which must be operated manually, is used for individual lifting of the lease rods. After insertion of the final cross cord, the lease rods can be returned to their start position, where they all assume equal distance from one another. Since the relative position of the uppermost and lowermost lease rods is never subjected to change, the angular sprectrum of the entire yarn web will remain constant. However, individual sheds will be opened within this spectrum through displacement of individual rods from above downwards. This has the disadvantage that each shed opens in another relative position, which considerable complicates automation of cross cord insertion. The size of the shed opening is also relatively tightly restricted. With this state of the art device, the cross cords are inserted manually.

A device is indeed made known in CH-A-679 867 with which, for sizing division, shed opening at all yarn levels takes place at the same position. For this purpose, instead of lease rods, a plurality of consecutively arranged heald shafts are used which are mounted to individually displace vertically. Here, each shaft can either raise or lower specific yarn groups. This type of yarn division is, however, relatively laborious since each individual shaft must be driven. Each yarn runs through its own relatively restricted heald eyelet, and must pass numerous shaft planes with the unstably heald shafts of the neighbouring yarns, which promotes yarn wear and results in inadequate production speeds.

It is therefore a purpose of the invention to create a device of the type mentioned in the introduction which, in the simplest way, ensures sufficiently large shed formation and a constant individual shed position, so that insertion of the cross cords can be better automated. This purpose is, according to the invention, fulfilled with a device which possesses the features in claim 1.

As opposed to state of the art devices with displacable lease rods, the relative position of the entire lease rod grid can be altered by means of a lifting device, and indeed in such a way that the lease rod grid is lifted out of the original working position. Equal displacement is also possible in the downwards direction, so that considerably larger sheds can generally be opened than with state of the art devices. The locking device enables individual release of the lease rods, the shed size being able to be determined by upper and lower guide rods, after passing the rod grid. These guide rods can also serve to uniformly limit the relative position of the individual sheds.

A particulary advantageous working method will arise if, in the direction of yarn run, in each case an upper and a lower horizontal guide rod for the upper and lower positional limitation of the yarn web is arranged after the rod grid, and if the lowermost lease rod in the upper operating position lies at approximately the height of the upper guide rod and if the uppermost lease rod in the lower operating position lies approximately at the height of the lower guide rod. These of basically state of the art guide rods are synchronously displaceable towards and away from one another, since they are also used to bring the yarn strip together into a common plane on activation of the cross reed. The maximum shed size can therefore also be set by appropriate adjustment of these guide rods.

The mechanical stop for the lease rod grid in the lower operating position is preferably directly formed by the lifting device. It would also be conceivable to form the mechanical stop independently from the lifting device, indeed either as a fixed or as an adjustable stop.

The locking device is advantageously provided with a locking element with which the respective lowermost lease rod in the upper operating position is lockable or releasable. This arrangement simplifies the mechanical requirements and improves operating security. It would however also be conceivable to allocate each individual lease rod its own lock, said lock also being able to function magnetically, for example.

A particularly simple locking device is formed by a rotatable slotted disk with one slot, on rotation said slot engaging in the plane of movement of the lease rod, the slot in each case displacing the lowermost lease rod in the downwards direction, while the lease rods lying above are locked. Out of engagement and in a neutral position, the lease rods can be moved past the slotted disc in order to lift the lease rod grid. In place of a slotted disc, other sequentially functioning locking gear would be conceivable, such as, for example a maltese cross drive, or an eccentric disc drive.

Lifting could be activated manually with a lever or with a crank handle. Preferably, however, it can be driven by means of its own drive motor so that the lifting movement can be controlled, together with the automatics for insertion of the lease rods. The same also applies to the locking device which is likewise equipped with its own drive motor.

Naturally, it would also be conceivable to carry out the entire leasing procedure from below upwards. To this end, the entire rod grid could be lowerable by means of a lowering device from a neutral middle position into a lower operating position. Subsequently, the lease rods would be displaceable by means of a lifting device, for example by means of a paternoster drive, into an upper operating position and there fixed there by means of a holding device. Also with this solution, it would be important that the upper and the lower operating positions are so selected to enable the formation of a large shed with the shed position remaining the same.

Figure 2:
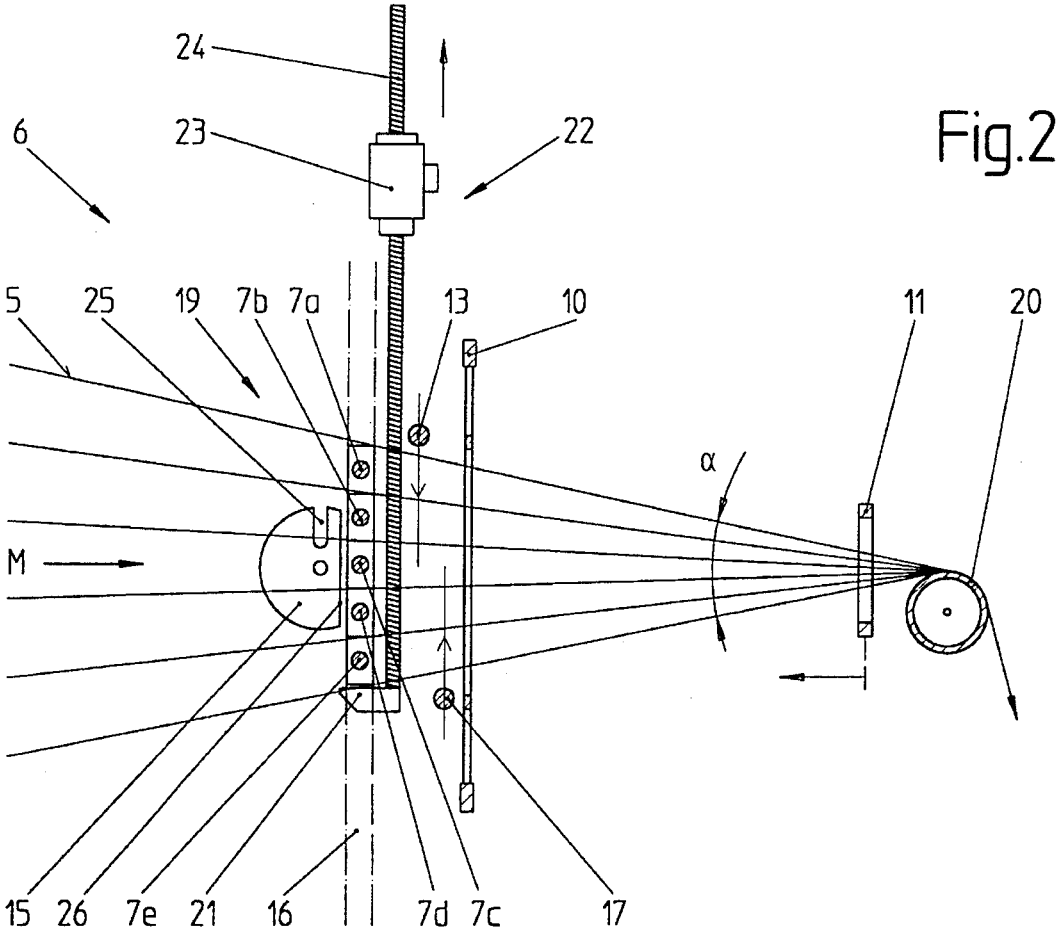
Figure 3:
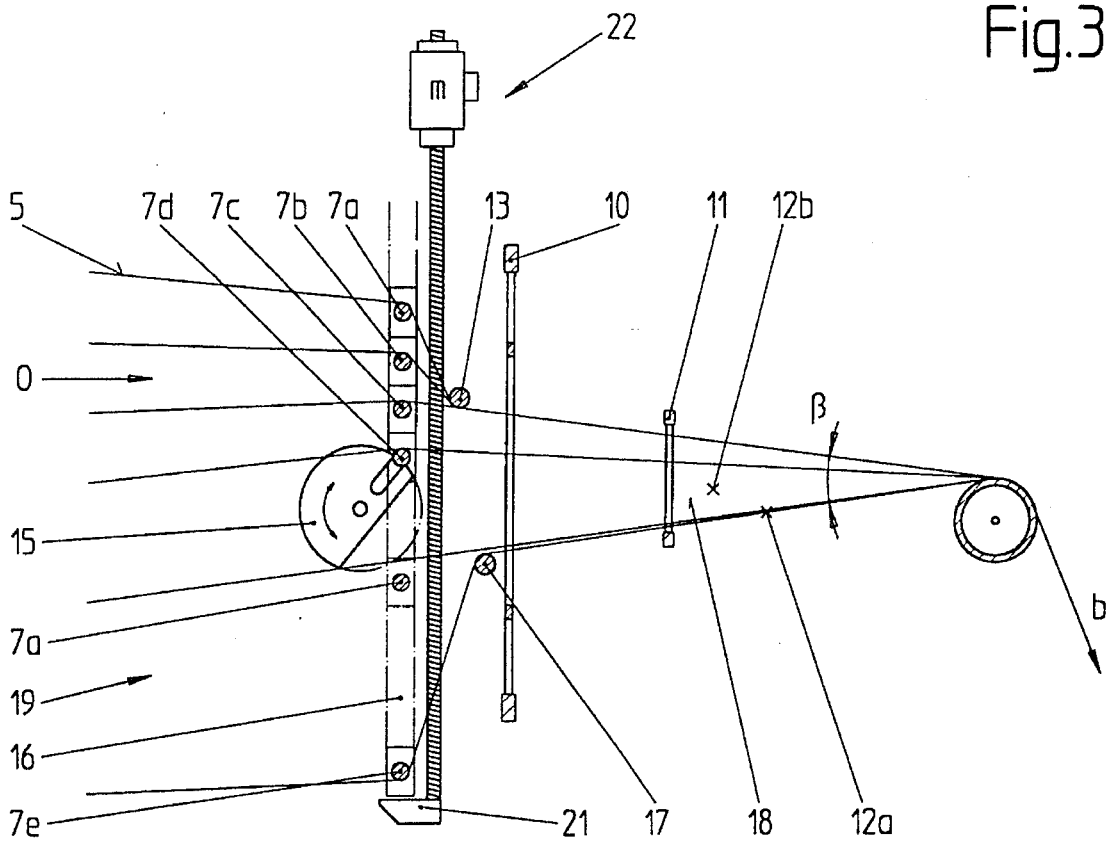
Figure 4:
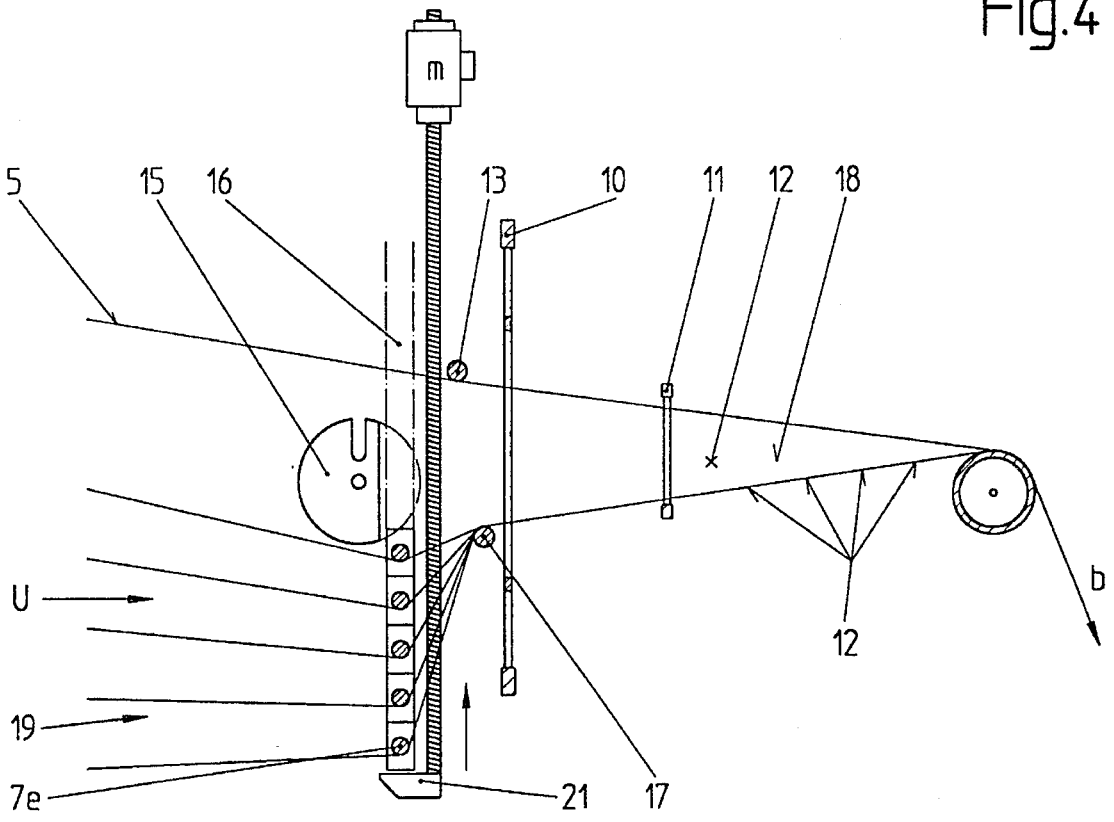
Figure 5:
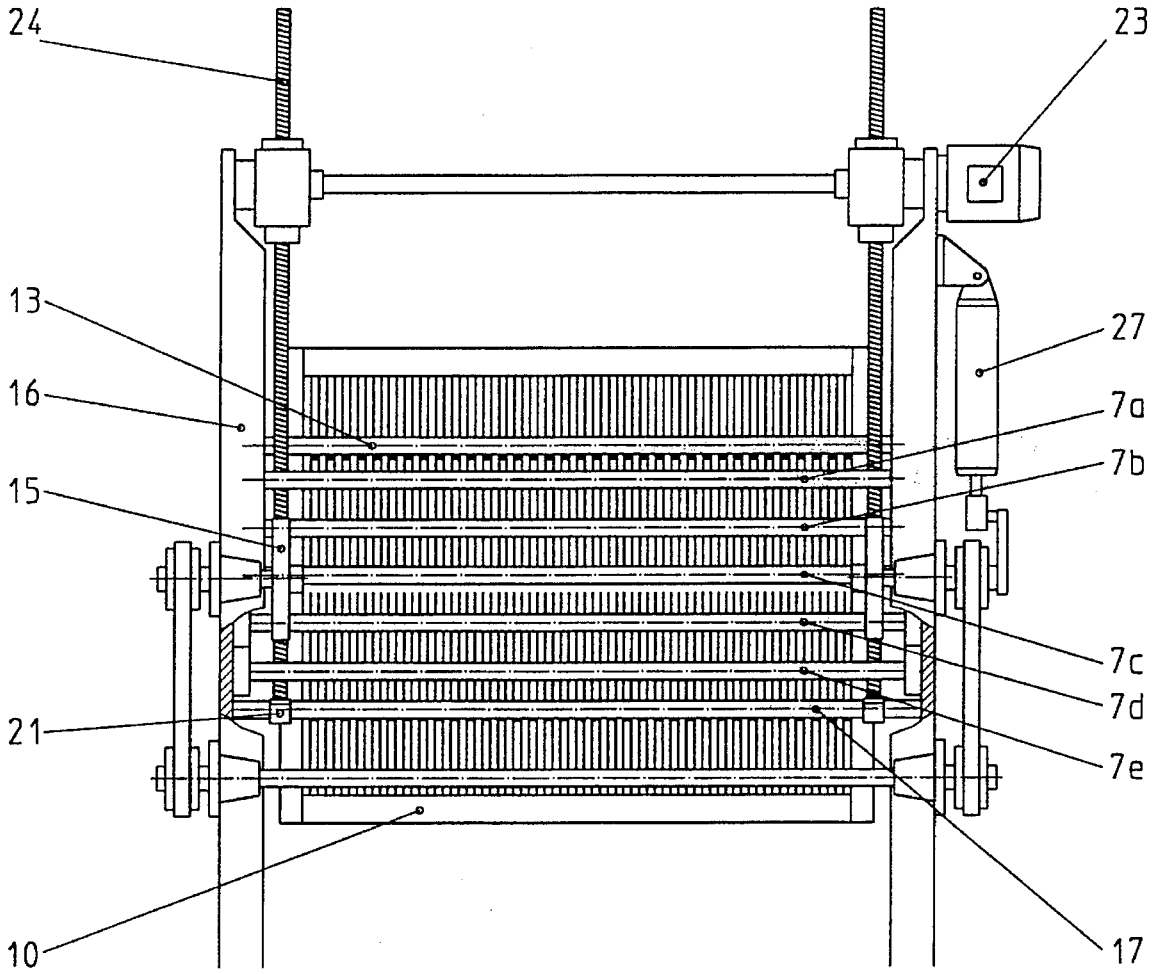

An embodiment is shown in the drawings, and is more closely described in the following. Namely:

FIG. 1 a schematic representation of a sectional warping plant,

FIG. 2 a side view of the device according to the invention, in the neutral middle position, FIG. 3 the device according to FIG. 2 during the formation of a shed, with a portion of the lease rods in the upper operating position, FIG. 4 the device according to FIG. 3 on formation of the final shed, with all lease rods in the lower operating position, and FIG. 5 a view of the device, seen in the direction of yarn run.

FIG. 1 shows the general arrangement of a warping plant 1 comprising a sectional warping machine 2 and a bobbin creel 3. The bobbin creel 3 is on several levels, and is equipped with various rows of bobbins 4 from which yarns 5 are wound off in the direction of the arrow a and wound onto a warping drum 9, in sections, to a warp winding 8. After completion of warp winding, the yarns are beamed onto a warp beam 14.

The individual yarn levels are separated from each other by the lease rods 7 in a lease rod holder 6. After passing the leasing rods, the yarns 5 then run through a cross reed 10 and a warping reed 11.

FIG. 2 shows the area of the lease rod holder 6 and the cross reed 10 in a somewhat enlarged scale. In principle, the lease rod holder comprises lateral guide rails 16 in which the lease rod grid 19, comprising lease rods 7*a* to 7*e*, is vertically displaceable. With that, the lease rods lie upon a mechanical stop 21 of a lifting device 22, said mechanical stop taking the form of a gripper. The lifting device comprises an electric motor 23, the drive of which engages in a lifting spindle 24.

In FIG. 2, the rod grid 19 assumes a neutral position M in which the yarns 5 are guided, without deflection, in a sector at an angle α to a deflection roller 20. In each case an upper guide rod 13 and a lower guide rod 17 are arranged outside of this sector. The cross reed 10, which here, with size division, performs no function, is likewise in a neutral middle position. The warp reed 11 is in the operating position at the deflection roller 20.

At least one slotted disc 15 (FIG. 5) is arranged next to the vertical guide rails 16, said slotted disc being able to rotate about an axis parallel to the lease rods. The slotted disc has a slot 25 running radially towards the centre, and a straight section 26. At the same time, the slotted disc is arranged in such a way that, in the rest position with its straight section 26 as shown in FIG. 2, it permits displacement of the rod grid 19 in the guide rails 16. Conversely, it will engage in the plane of movement of the rod grid 19 on rotation outwards. In order to avoid tilting and jamming of the lease rods in the guide rails 16, preferably in each case a slotted disc is arranged at each side of the lease rods.

For the formation of a shed in order to insert the cross cords 12, according to FIG. 3 the guide rods 13 and 17 are moved towards one another slightly so that the yarn warp will be limited to a somewhat smaller sector β. At the same time, the warp reed 11 is moved back in the direction of the bobbin creel, since the cross cords must obviously be inserted behind the warp reed. With the aid of the lifting device 22, after that the entire rod grid 19 is raised until the lowermost lease rod 7*e* comes to lie at approximately the same height as the upper guide rod 13. With that, obviously all the yarns, right down to the lowermost level, are initially deflected downwards on the individual guide rods.

On reaching this upper operating position O, the slotted disc 15 is pivoted in so that the rod grid is held there. The mechanical stop 21 can now be lowered again to a position in which it defines a lower operating position U. Thereupon, the slotted disc 15 will oscillate forwards and back, a lease rod being grasped each time by the slot 25 and guided so far downwards until it falls downwards in the guide rails 16 through the force of gravity. At the same time, the slotted disc will retain the lease rod situated above.

In FIG. 3, the lower leansing rod 7*e* has already fallen into the lower operating position U. The next lease rod 7*d* is just being gripped by the slotted disc and guided downwards, with a cross cord 12*b* being inserted in the yarn shed 18. A first cross cord 12*a* has already been inserted in the preceding sequence. Between the individual sequences, in each case the yarn strip must carry out a tensioning movement in the direction of the arrow b. This tensioning movement assists sure formation on the guide rods 13 and 17 of a shed opening to the shed leasing area 18, in spite of any mutual adherence of yarns, and brings the cross cords 12 to a correct working distance in the warp 8.

It can be seen from FIG. 4 that the lower operating position U is determined in such a way that the uppermost lease rod 7*a* lies approximately at the same height as the lower guide rod 17. Between the first and last sequence, the yarns defining the shed will however always be deflected over the guide rods 13 and 17 so that the yarn shed always assumes the same relative position. After insertion of the last cross cord, the slotted disc 15 will rotate back into the rest position so that the rod grid 19 can be returned into the middle position M by means of the lifting device. In this middle position, the yarns 5 run through the rod grid without deflection and at production speed.

FIG. 5 shows the lateral arrangement of the transmission for the drive of the slotted discs. Both the spindles 24 are driven by a motor 23 and the slotted discs can by pivoted synchronously by means of a pressure cylinder 27.

Inasmuch as the invention is subject to modifications and variations, the foregoing description and accompanying drawings should not be regarded as limiting the invention, which is defined by the following claims and various combinations thereof:

I claim:

1. In a device for dividing yarns on a sectional warping machine having a lease rod holder comprising a plurality of horizontal lease rods forming a grid in which the distance between adjacent lease rods can be increased in order to form a shed on a yarn warp passing through the grid, the improvement, in combination therewith, comprising means for moving the entire grid in a vertical plane between an upper operating position, a neutral middle position, and a lower operating position, a mechanical stop for supporting the rod grid in its lower operating position, a lifting device for raising the rod grid to its raised operating position, and a locking device for holding the lease rods in their upper operating position, said locking device comprising means for releasing the lease rods sequentially, allowing each to fall to its lower operating position.

2. The invention of claim 1, further comprising an upper guide rod and a lower guide rod for defining respectively the upper and lower position of the yarn warp, said rods being disposed downstream of the rod grid so that, in the upper operating position, the lowermost lease rod lies approximately level with the upper guide rod, and in the lower operating position, the uppermost lease rod lies approximately level with the lower guide rod.

3. The invention of claim 1, wherein the mechanical stop if is formed by a portion of the lowered lifting device.

4. The invention of claim 1, wherein the locking device has a releasing element for releasing lease rods individually from the raised grid of lease rods.

5. The invention of claim 4, wherein the locking device is a rotatable disc, and the releasing element is a slot formed in the disc, which slot intersects the plane of movement of the lease rods as the disc rotates, sequentially engaging each lowermost lease rod, releasing it from the grid so that it can fall to its lower operating position, while the lease rods in the grid remain locked in their raised position.

6. The invention of claim 1, further comprising means for driving the lifting device.

7. In a device for dividing yarns on a sectional warping machine having a lease rod holder comprising a plurality of horizontal lease rods forming a grid in which the distance between adjacent lease rods can be increased in order to form a shed on a yarn warp passing through the grid, the improvement, in combination therewith, means for moving the entire grid in a vertical plane between from a neutral middle position to a lower operating position, a mechanical stop for supporting the rod grid in its lower operating position, means for raising the rods individually to a raised operating position, and a locking device for thereafter holding the lease rods in their upper operating position.

* * * * *